US010295308B2

(12) United States Patent
Chavez

(10) Patent No.: US 10,295,308 B2
(45) Date of Patent: May 21, 2019

(54) RAIL SYSTEM FOR A FIREARM

(71) Applicant: Adrian Chavez, Las Vegas, NV (US)

(72) Inventor: Adrian Chavez, Las Vegas, NV (US)

(73) Assignee: Salient Arms International, Las Vegas, NV (US)

( * ) Notice: Subject to any disclaimer, the term of this patent is extended or adjusted under 35 U.S.C. 154(b) by 0 days.

(21) Appl. No.: 15/405,775

(22) Filed: Jan. 13, 2017

(65) Prior Publication Data

US 2017/0205203 A1 Jul. 20, 2017

Related U.S. Application Data

(60) Provisional application No. 62/278,783, filed on Jan. 14, 2016.

(51) Int. Cl.

| | |
|---|---|
| ***F41C 27/00*** | (2006.01) |
| ***F41G 11/00*** | (2006.01) |
| ***F41A 11/02*** | (2006.01) |
| ***F41A 3/66*** | (2006.01) |
| ***F41A 21/32*** | (2006.01) |
| ***F41A 21/36*** | (2006.01) |

(52) U.S. Cl.

CPC ..... *F41G 11/003* (2013.01); *F41A 3/66* (2013.01); *F41A 11/02* (2013.01); *F41A 21/325* (2013.01); *F41A 21/36* (2013.01); *F41C 27/00* (2013.01)

(58) Field of Classification Search

CPC ..... F41C 27/00; F41C 23/16

See application file for complete search history.

(56) References Cited

U.S. PATENT DOCUMENTS

| | | | |
|---|---|---|---|
| 1,939,700 | A | 12/1933 | Hofstetter |
| 4,536,982 | A | 8/1985 | Bredbury et al. |
| 4,663,875 | A | 5/1987 | Tatro |
| 5,831,202 | A | 11/1998 | Rustick |
| 7,789,009 | B1 | 9/2010 | Brittingham |
| 8,336,243 | B2 | 12/2012 | Langevin et al. |

(Continued)

FOREIGN PATENT DOCUMENTS

WO WO-2009082520 7/2009

OTHER PUBLICATIONS

"Non-Final Office Action", U.S. Appl. No. 15/406,120, dated Nov. 22, 2017, 6 pages.

(Continued)

*Primary Examiner* — Stephen Johnson
(74) *Attorney, Agent, or Firm* — SBMC

(57) ABSTRACT

A rail system for a firearm is described. In one example, an apparatus includes a barrel nut and a modular rail. The barrel nut is configured to secure a barrel of a firearm and has a non-circular outer surface when taken along an axis that is perpendicular to an axis of the barrel when secured to the firearm. The modular rail has an inner portion having a shape that is complementary to the barrel nut such that the modular rail does not rotate about the axis of the barrel when the inner portion is mated to the outer surface of the barrel nut. The outer surface of the barrel nut may also comprise a cavity and the modular rail may further comprise a rotatable assembly configured to engage the cavity of the barrel nut such that the modular rail does not move along the axis of the barrel.

16 Claims, 17 Drawing Sheets

(56) References Cited

U.S. PATENT DOCUMENTS

| | | | | |
|---|---|---|---|---|
| 8,607,490 | B1 * | 12/2013 | Zinsner | F41C 23/16 42/71.01 |
| 8,863,426 | B1 * | 10/2014 | Zinsner | F41C 23/16 42/71.01 |
| 9,377,263 | B1 | 6/2016 | Sy | |
| 2012/0180358 | A1 * | 7/2012 | Samson | F41A 13/12 42/71.01 |
| 2017/0205179 | A1 | 7/2017 | Chavez | |

OTHER PUBLICATIONS

"Final Office Action", U.S. Appl. No. 15/406,120, dated Apr. 27, 2018, 7 pages.
"Non-Final Office Action", U.S. Appl. No. 15/406,120, dated Oct. 22, 2018, 5 pages.
"Notice of Allowance", U.S. Appl. No. 15/406,120, dated Feb. 25, 2019, 5 pages.

* cited by examiner

RAIL SYSTEM FOR A FIREARM

RELATED APPLICATIONS

This application claims priority to U.S. Provisional Patent Application No. 62/278,783, filed Jan. 14, 2016 to Adrian Chavez and titled "Rail System and Brake," the entire disclosure of which is hereby incorporated by reference. This application also incorporates by reference in its entirety U.S. patent application Ser. No. 15/406,120, filed Jan. 13, 2017 to Adrian Chavez, and titled "Muzzle Brake for a Firearm," which also claims priority to U.S. Provisional Patent Application No. 62/278,783, filed Jan. 14, 2016 to Adrian Chavez

BACKGROUND

Rails are typically configured to mount to a firearm's "upper" portion that includes a barrel to mount accessories, such as mounts, grips, flashlights, optics, and so forth. Conventional techniques that are used to mount these rails to the firearm, however, often require tools to attach. Additionally, these conventional rails can rotate in relation to the barrel or upper, thereby causing a change in alignment any time the rails are removed from or remounted the firearm.

Additionally, accessories that mount at the end of a barrel, such as flash hiders, muzzle brakes, and so on have found commercial success in a civilian market. However, these accessories have not found success in tactical operations, such as military or police forces because of the effects these accessories have on surrounding personnel, such as the sounds and other such side effects of gases being vented through these accessories toward the surrounding personnel.

SUMMARY

Loom A rail system for a firearm is described. In one example, an apparatus includes a barrel nut and a modular rail. The barrel nut is configured to secure a barrel of a firearm and has a non-circular outer surface when taken along an axis that is perpendicular to an axis of the barrel when secured to the firearm. The modular rail has an inner portion having a shape that is complementary to the barrel nut such that the modular rail does not rotate about the axis of the barrel when the inner portion is mated to the outer surface of the barrel nut. The outer surface of the barrel nut may also comprise a cavity and the modular rail may further comprise a rotatable assembly configured to engage the cavity of the barrel nut such that the modular rail does not move along the axis of the barrel.

In another example, a method comprises inserting a barrel into a firearm receiver and securing the barrel to the firearm receiver with a barrel nut. The barrel nut has a non-circular outer surface when taken along an axis that is perpendicular to an axis of the barrel and a cavity formed in the non-circular outer surface. A modular rail is then mounted to the barrel nut, the modular rail including a rotatable assembly and an inner portion having a shape that is complementary to the barrel nut such that the modular rail does not rotate about the axis of the barrel when the inner portion is in contact with the outer surface of the barrel nut. The method then locks the modular rail to the barrel nut by rotating a portion of the rotatable assembly of the modular rail into the cavity of the barrel nut such that the modular rail does not move along the axis of the barrel.

In a further example, an apparatus includes an upper receiver configured to house a bolt carrier group, a barrel seated in a threaded barrel receiving portion of the upper receiver, and a barrel nut that secures the barrel to the upper receiver. The barrel nut has a threaded inner portion with threads complimentary to those of the threaded barrel receiving portion of the upper receiver and a non-cylindrical outer surface that includes a cavity. A modular rail of the apparatus has an inner portion having a shape that is complementary to the barrel nut such that the modular rail does not rotate about the axis of the barrel when the inner portion is mated to the outer surface of the barrel nut. The modular rail also includes a rotatable assembly configured to engage the cavity of the barrel nut such that the modular rail does not move along the axis of the barrel.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

DETAILED DESCRIPTION

Overview

Figure 1:
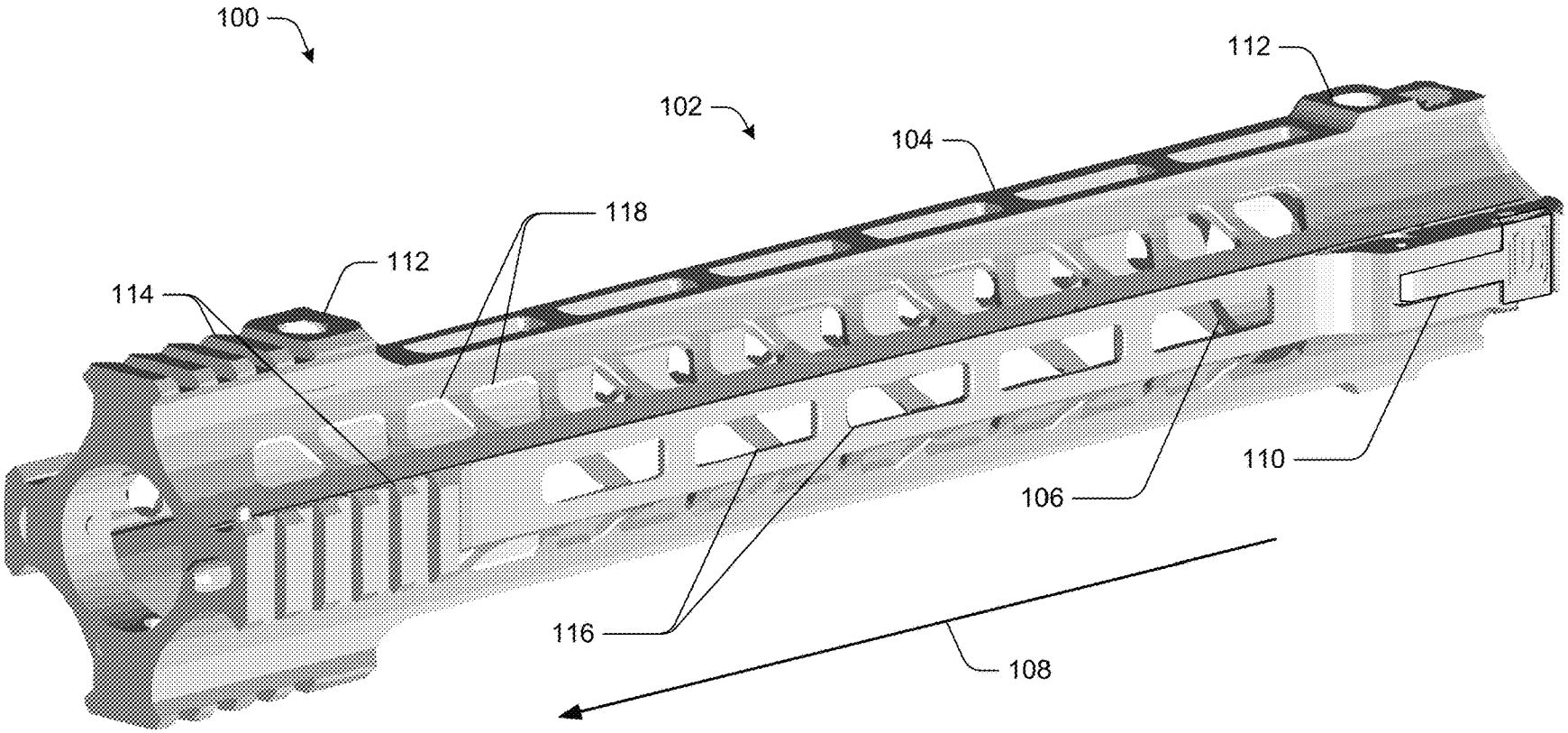
FIG. 1 is an isometric view of a rail system for a firearm taken generally from an underside view of the rail system and showing a modular rail and barrel nut of the rail system.

Conventional rails are typically configured to mount to a firearm's upper portion or receiver that includes a barrel to mount accessories, such as mounts, grips, flashlights, optics, and so forth. These conventional rails are often mounted to a cylindrical or round barrel nut that secures the barrel to the upper receiver of the firearm. Because of the round or cylindrical geometry of the barrel nut, however, the rail can rotate or twist in relation to the barrel or upper receiver of the firearm. This rotation can cause a change in alignment either during use of the firearm or when the rails are removed from or remounted to the firearm, thereby affecting an alignment of the rail and accessories (e.g., aiming devices or optics). Additionally, conventional techniques for mounting the rail to the barrel nut often require tools due to the use of complex fasteners or sheer force involved in tightening the rail to the barrel nut in an attempt to prevent rotation. As such, initial setting or correction of the rail's alignment can be difficult and frustrating, particularly when deployed in a field of operation in which access to tools is limited.

Accordingly, a rail system is described that does not suffer from these drawbacks. In one example, a rail system includes a barrel nut and a modular rail. The barrel nut is configured to secure a barrel of a firearm and has a non-circular outer surface when taken along an axis (or across a plane) that is perpendicular to an axis of the barrel when secured to the firearm. The modular rail has an inner portion having a shape that is complementary to the barrel nut such that the modular rail does not rotate about the axis of the barrel when the inner portion is mated to the outer surface of the barrel nut. The outer surface of the barrel nut may also comprise a cavity and the modular rail may further comprise a rotatable assembly configured to engage the cavity of the barrel nut such that the rail system does not move along the axis of the barrel. In this way, the geometry and/or mating surfaces of the barrel nut prevent the modular rail from rotating and the rotatable assembly of the modular rail secures or locks the modular rail to the barrel nut.

In some aspects, the barrel nut is indexed or timed to the firearm receiver (or barrel) such that alignment features of the barrel nut enable consistent alignment of the modular rail. In other words, once a barrel is secured to the receiver with the barrel nut of the rail system, and the barrel nut is properly timed, the timing of the barrel nut may ensure correct and consistent alignment of the modular rail. Thus, the modular rail can be removed from the barrel nut and subsequently remounted to the barrel nut with consistent alignment and mating of these parts. In some cases, this is effective to enable "return to zero" of optics, aiming devices, or other accessories mounted to the modular rail, which may preclude the need to re-aim or re-calibrate the accessories each time the modular rail is installed or mounted. Alternately or additionally, the rotating assembly of the modular rail by which the rail locks to the barrel nut may be manipulable by hand or without the use of tools. Accordingly, users may easily remove the modular rail, remount the modular rail, or even swap modular rails depending on desired configurations or accessories of a given rail. Additional discussion of these and other aspects of the rail system are included in the following sections.

In the following discussion, an example environment is first described that may employ the rail system described herein. Examples of installation and removal, including a method, are then described which may be performed within the example environment or other environments. Consequently, performance of the example installation or removal described is not limited to the example environment and the example environment is not limited to performance of the example installation and removal techniques.

Rail System

FIG. 1 is an isometric view 100 of a rail system 102 generally from an underside of the rail system and showing various features of the rail system. The rail system 102 includes a modular rail 104 and a barrel nut 106, to which the modular rail 104 mounts or attaches. The rail system 102 may be used with any suitable type for firearm, such as gas or piston operated AR-15 type rifles and similar variants. Generally, the barrel nut 106 can be used to secure a barrel to a firearm receiver such that a chamber, extension, or throat of the barrel is secured to a barrel receiving portion of the receiver. Thus, the barrel of the firearm, or a bore thereof, runs substantially parallel to a longitudinal axis 108 of the rail system as shown in FIG. 1. A muzzle of the barrel may terminate near or extend through an end of the modular rail 104 opposite of an end at which the modular rail mounts to the barrel nut 106. The implementations and use of the barrel nut 106 vary, and are described throughout this disclosure.

The modular rail 104 of the rail system 102 also includes a rotatable assembly 110, which can be used to secure the modular rail 104 to the barrel nut and the firearm receiver. The implementations and use of the rotatable assembly 110 vary, and are described throughout this disclosure. Alternately or additionally, the modular rail 104 may include any suitable mounting features, slots, or interfaces. In this particular example, the modular rail includes quick-disconnect sockets 112, sections of MIL-STD-1913 rail 114, M-LOK® interface slots 116, and trapezoidal concave slots 118, which may be useful for mounting accessories along or in the concave profile of the modular rail 104. In some cases, the modular rail includes KeyMod™ slots or other types of mounting features. Although the modular rail 104 includes multiple instances of these various features, references to each in FIG. 1 are reduced here for brevity and visual clarity.

Figure 2A:
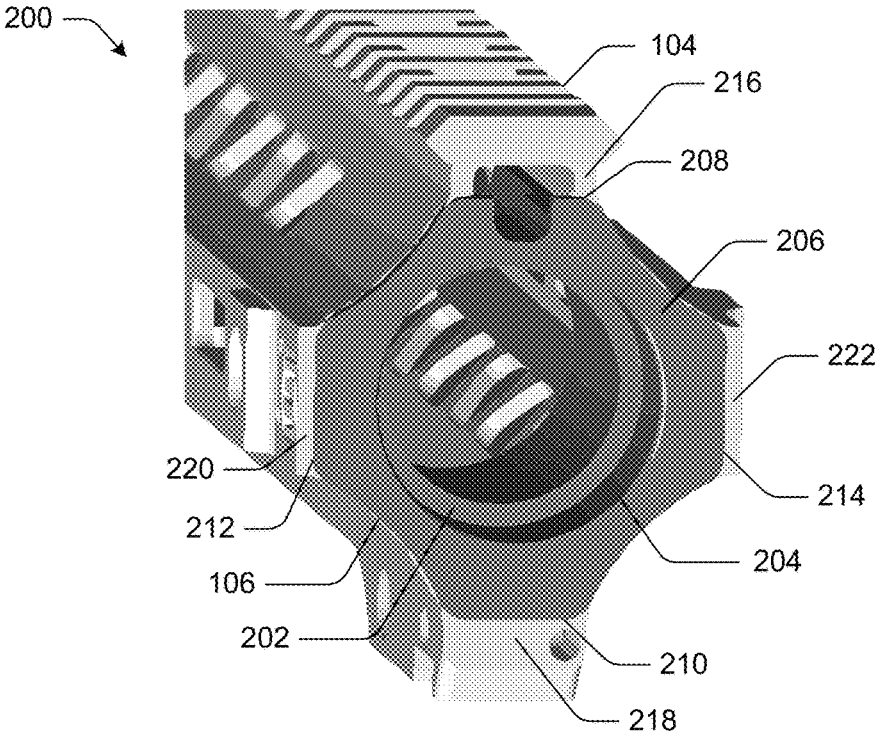
FIG. 2A depicts an isometric view of the rail system of FIG. 1 taken generally from a rear of the rail system and showing an inner portion of the barrel nut.
Figure 2B:
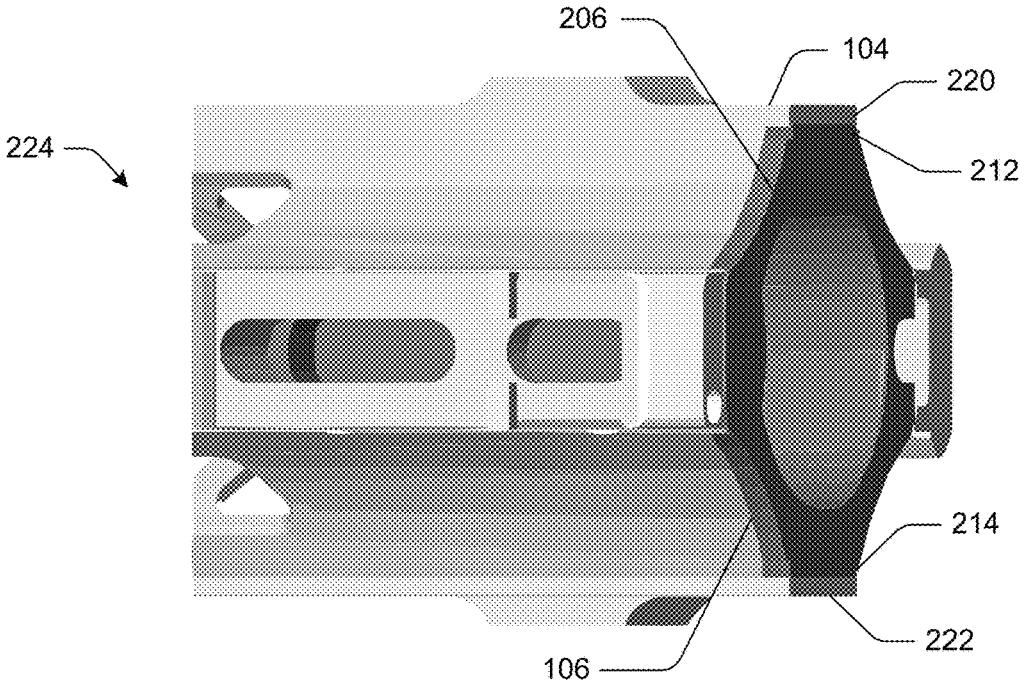
FIG. 2B depicts an isometric view of the rail system of FIG. 1 taken generally from below the rail system.

FIG. 2A depicts an isometric view 200 of the rail system of FIG. 1 taken generally from a rear of the rail system and showing an inner portion of the barrel nut. FIG. 2B depicts an isometric view of the rail system of FIG. 1 taken generally from below the rail system. In this portion of the description, discussion is made interchangeably to FIGS. 2A and 2B.

As shown in FIG. 2A, an inner portion of the barrel nut 106 may include an internal shoulder 202 and a threaded portion 204. The internal shoulder 202 of the barrel nut 106 may be configured to receive or mate with a collar of a barrel extension. The threaded portion 204 of the barrel nut 106 is configured with threads complimentary to those of the firearm receiver. As such, when installing the barrel into a firearm receiver, the barrel nut 106 placed over an extension of the barrel and threaded onto the receiver's threads. The barrel nut 106 can then be tightened such that the internal shoulder 202 engages the collar of the barrel extension to secure the barrel to the firearm receiver.

A rear flange surface 206 of the barrel nut 106 includes first, second, third, and alignment portions 208, 210, 212, 214. The first and second alignment portions 208, 210 in the illustrated example can define a top and bottom when installed on a firearm receiver and are disposed opposite of each other. The third and fourth alignment portions 212, 214 in the illustrated example define a left and right sided when installed on a firearm and looking along an axis of a barrel installed in the firearm receiver. Each of the first, second, third, and fourth alignment portions 208, 210, 212, 214 are configured to contact or engage with corresponding alignment portions 216, 218, 220, 222 of the modular rail 104. As shown at 224, a rear face of the modular rail 104 may include a recess to receive the rear flange surface of the barrel nut 106. When the modular rail 104 is properly seated over the barrel nut 106, the rear flange surface 206 and alignment features thereof can nest within (or sit flush with) this recess and align the modular rail 104 to the barrel nut 106.

Figure 3A:
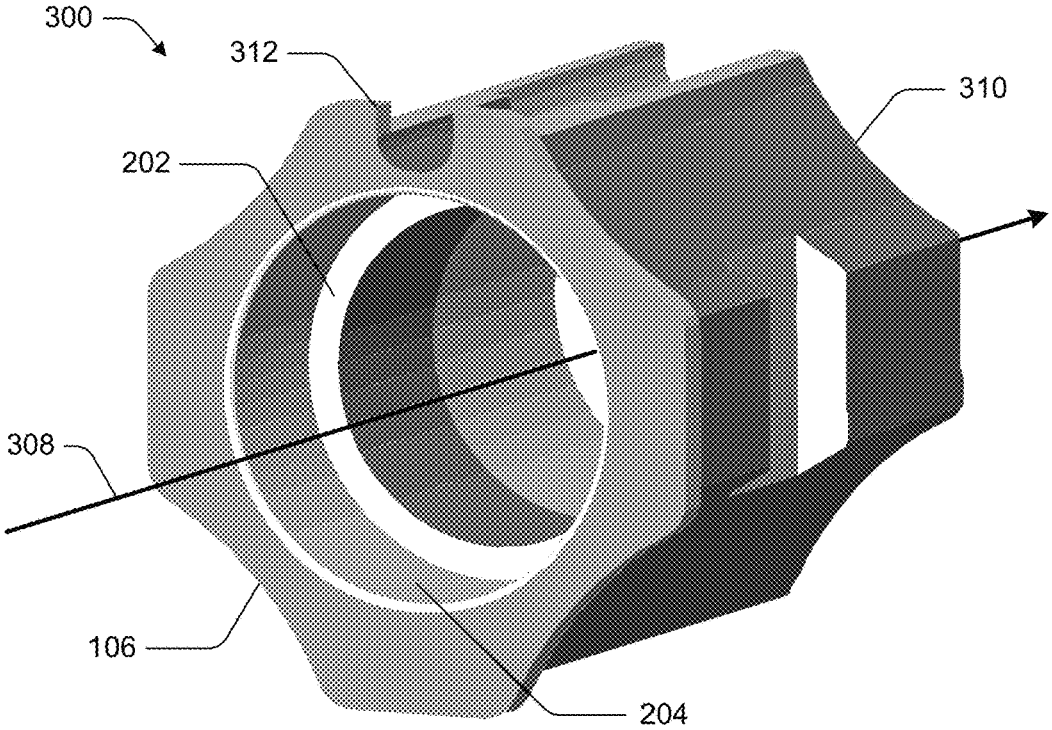
FIG. 3A depicts an isometric view of a barrel nut of the rail system generally from a rear that is nearer a firearm receiver when installed.
Figure 3B:
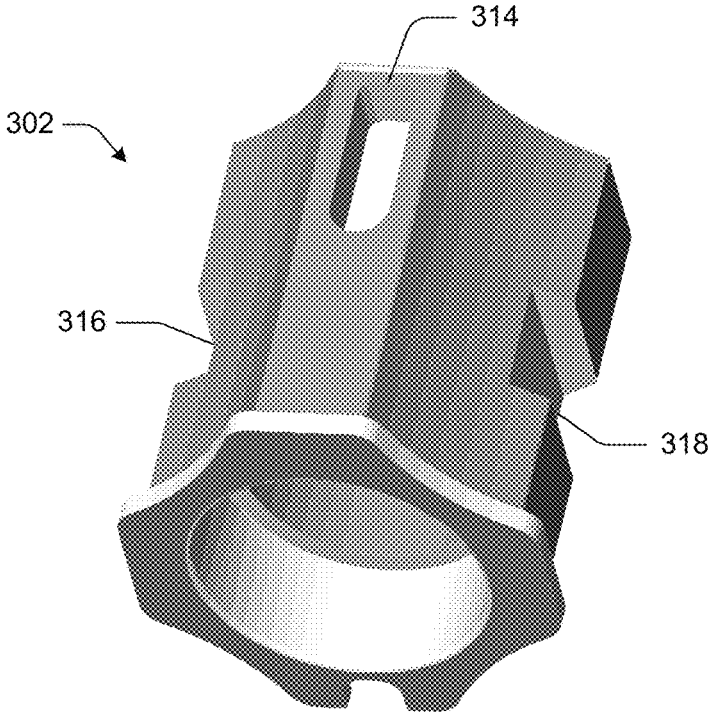
FIG. 3B depicts an isometric view of the barrel nut generally from below and showing a cavity of the barrel nut's outer surface.
Figure 3C:
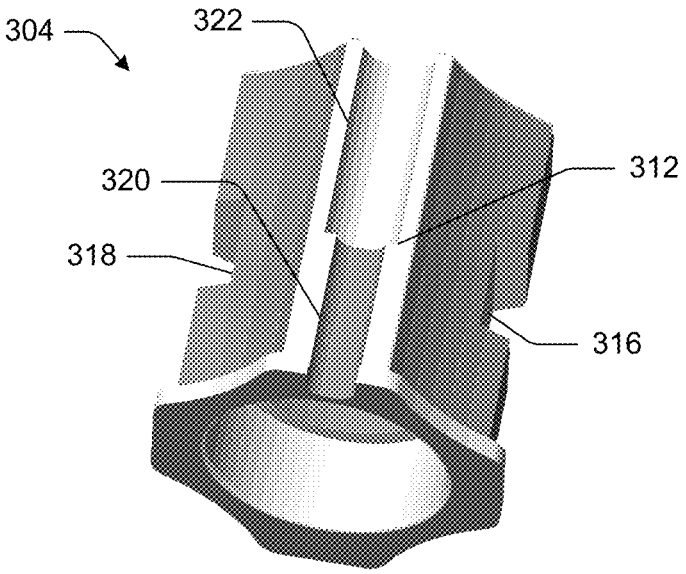
FIG. 3C depicts an isometric view of the barrel nut generally from above and a rear that is nearer the firearm receiver when installed.
Figure 3D:
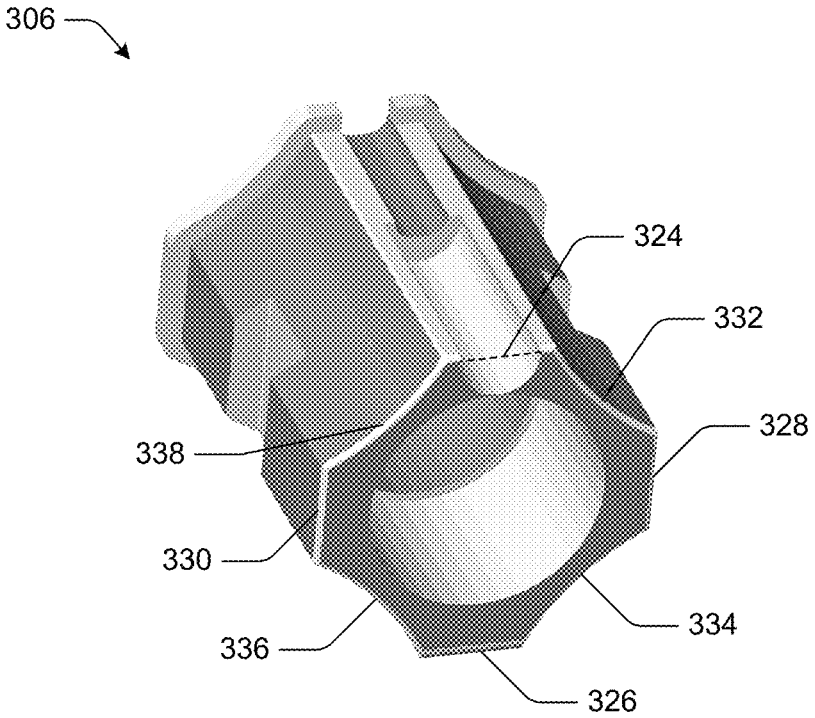
FIG. 3D depicts an isometric view of the barrel nut generally from above and a front that is farther from the firearm receiver when installed.

FIG. 3A depicts an isometric view 300 of the barrel nut of the rail system generally from a rear that is nearer a firearm receiver when installed. FIG. 3B depicts an isometric view 302 of the barrel nut generally from below and showing a cavity of the barrel nut's outer surface. FIG. 3C depicts another isometric view 304 of the barrel nut generally from above and a rear that is nearer the firearm receiver when installed. FIG. 3D depicts an isometric view 306 of the barrel nut generally from above and a front that is farther from the firearm receiver when installed. In this portion of the description, discussion is made interchangeably to FIGS. 3A-3D.

FIG. 3A illustrates the barrel nut 106 of the rail system 102 generally at 300. As described with reference to FIGS. 2A and 2B, the barrel nut includes an internal shoulder 202 to engage a barrel and a threaded portion 204 by which the barrel nut is threaded onto a firearm receiver to secure the barrel. A longitudinal axis 308 of the barrel nut 106 may be defined as substantially parallel to an axis or bore of a barrel when installed on the firearm receiver. The barrel nut 106 also includes an outer surface 310 to provide an interface to an interior surface of the modular rail 104 for mounting and a channel 312 to facilitate clearance for a gas tube or piston system of a firearm. With respect to another axis or plane perpendicular to the longitudinal axis 308, the outer surface 310 is non-circular or non-cylindrical and thus prevent rotation or twisting of the modular rail 104 when mounted to the barrel nut 106. In this particular example, a profile of the outer surface 310 comprises substantially flat and concave portions that extend along the longitudinal axis 308 of the barrel nut 106.

The channel 312 may be located along or define a top of the barrel nut 106 and run parallel to the longitudinal axis 308. In some cases, the channel 312 can be used to time or index the barrel nut 106 to the firearm receiver by aligning the channel 312 with a gas tube passage of the firearm receiver. As shown at 302, the barrel nut 106 also includes a cavity 314, which may be located on the outer surface 310 approximately opposite of the channel 312. The cavity 314 may be configured with any suitable depth, width, or length along the outer surface 310 of the barrel nut 106. In some aspects, the cavity 314 provides a point of contact by which the modular rail 104 can be locked or secured to the barrel nut 106 and associated firearm receiver.

To facilitate torquing or indexing, the barrel nut 106 may include wrench flats 316 and 318 located on opposite sides of the outer surface 310. Although shown as being located on opposing sides of the barrel nut 106, the wrench flats 316 and 318 may be located on a top and bottom of the barrel nut 106. Alternately or additionally, the rear flange surface 206 of the barrel nut 106 can include notches or holes configured to engage pins of a standard AR-15 armorer's tool or wrench.

FIG. 3C illustrates the channel 312 of the barrel nut 106 generally from above at 304. In this particular example, the channel 312 includes a narrow section 320 that extends through the rear flange surface 206 and may serve as a visual aid for indexing or timing the barrel nut 106 to the receiver. On opposite sides of the barrel nut 106, the wrench flats 316 and 318 may be implemented as flat, parallel sections of the outer surface 310 oriented substantially perpendicular to the longitudinal axis 308 of the barrel nut 106.

The another view of the outer surface 310 of the barrel nut 106 is shown at 306 of FIG. 3D. As described herein, the outer surface 310 of the barrel nut 106 may have a non-circular profile or shape effective to prevent rotation or twisting movement of the modular rail 104 with respect to the barrel or firearm receiver. In this particular example, the outer surface 310 includes first, second, third, and fourth surface portions 324, 326, 328, 330. The first and second surface portions 324, 326 in the illustrated example define a top (with gas tube channel) and bottom when installed on a firearm that are disposed opposite of each other. The third and fourth surface portions 328, 330 in the illustrated example define a left and right sided when installed on a firearm and looking along a direction of the longitudinal axis 308. Thus, each of the first, second, third, and fourth surface portions 324, 326, 328, 330 follow the longitudinal axis 308 and are configured to engage or support a corresponding inner surface of the modular rail 104.

The first, second, third, and fourth surface portions are joined together in this example by first, second, third, and fourth joining portions 332, 334, 336, 338. Together, these portions form a non-circular or irregular shape that may prevent rotation of the modular rail 104 and support an irregularly shaped modular rail as further described in the following. The first, second, third, and fourth joining portions 332, 334, 336, 338 are inwardly sloped along an arc between respective rail portions (e.g., concave), thus forming a cross-like appear when viewed along this axis. Other examples are also contemplated, such as a continuously round shape, hexagonal, octagonal, and so forth.

Figure 4A:
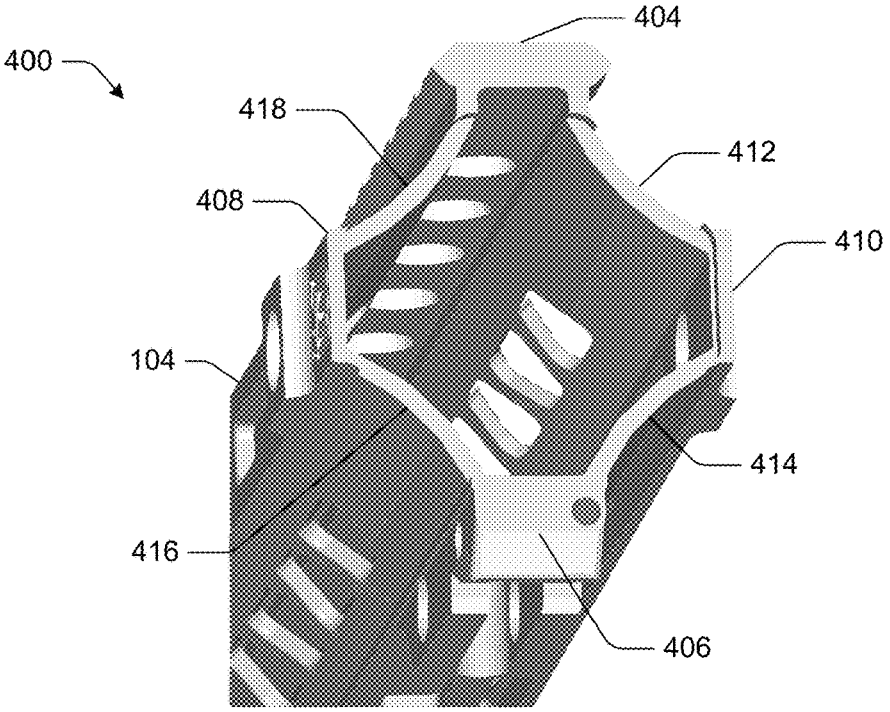
FIG. 4A depicts an isometric view of the modular rail of FIG. 1 taken from below and generally from a rear of the rail nearer the firearm receiver when installed.
Figure 4B:
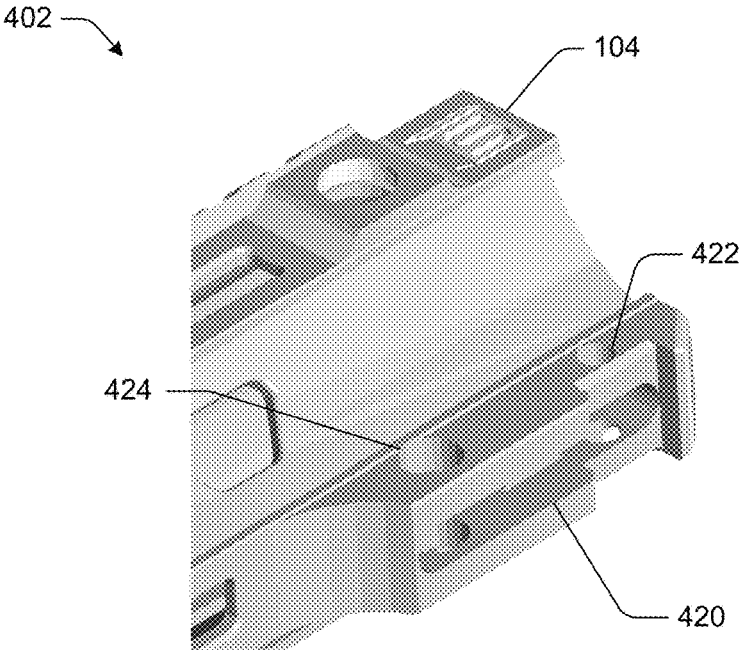
FIG. 4B depicts an isometric view of the modular rail taken from generally below and showing features configured to house moving assemblies of the rail system.

FIG. 4A depicts an isometric view 400 of the modular rail taken from below and generally from a rear of the rail nearer the firearm receiver when installed. FIG. 4B depicts an isometric view 402 of the rail system taken from generally below and showing features configured to house moving assemblies of the rail system. In this portion of the description, discussion is made interchangeably to FIGS. 4A and 4B. The modular rail includes first, second, third, and fourth rail portions 404, 406, 408, 410.

The first and second rail portions 404, 406 in the illustrated example define a top and bottom when installed on a firearm that are disposed opposite of each other. The third and fourth rail portions 408, 420 in the illustrated example define a left and right sided when installed on a firearm and looking along a direction of travel of a bullet or longitudinal axis 308. Thus, each of the first, second, third, and fourth rail portions 404, 406, 408, 410 follow the longitudinal axis 308 and are configured to support mounting of accessories thereto. As such, the first, second, third, and fourth rail portions 404, 406, 408, 410 may be configured to support such mounting in a variety of ways, such as in accordance with MIL-STD-1913, M-LOK®, KeyMod™, and so forth.

The first, second, third, and fourth rail portions 404, 406, 408, 410 are joined together in this example by first, second, third, and fourth joining portions 412, 414, 416, 418. Together, these portions form an irregular shape or profile of the modular rail and may be continued via a muzzle brake or other attachments with a similar profile. The first, second, third, and fourth rail portions 404, 406, 408, 410 may define opposing flat surfaces that are normal to an axis that is perpendicular to the longitudinal axis 108. The first, second, third, and fourth joining portions 412, 414, 416, 418 are inwardly sloped along an arc between respective rail portions (e.g., concave), thus forming a cross-like appear when viewed along this axis. In at least some aspects, respective inner surfaces of these rail and joining portions engage with or contact corresponding surfaces of the barrel nut effective to prevent rotation of the modular rail about the barrel nut or barrel of the firearm.

The modular rail 104 also includes a slot 420 to house a rotatable assembly and a transverse hole 424 to support a pin about which the rotatable assembly may turn. Alternately or additionally, the modular rail may also include a transverse hole 422 to support a sliding assembly that is configured to engage the rotatable assembly in at least one position. The use and implementation of these assemblies vary, and is described in greater detail below.

Figure 5A:
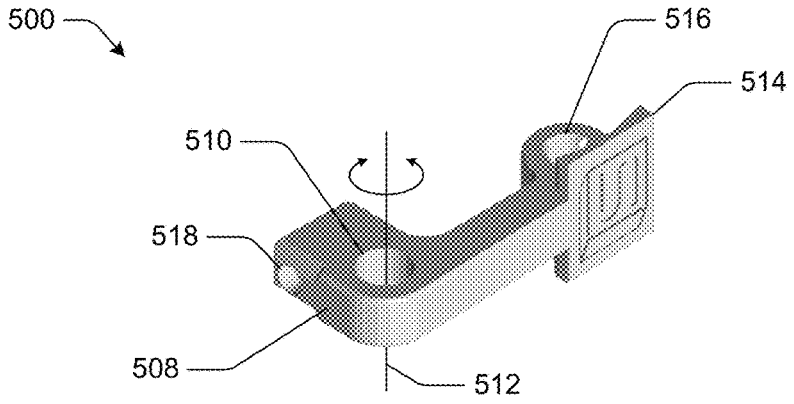
FIG. 5A depicts an isometric view of a lever of the rail system of FIG. 1.
Figure 5B:
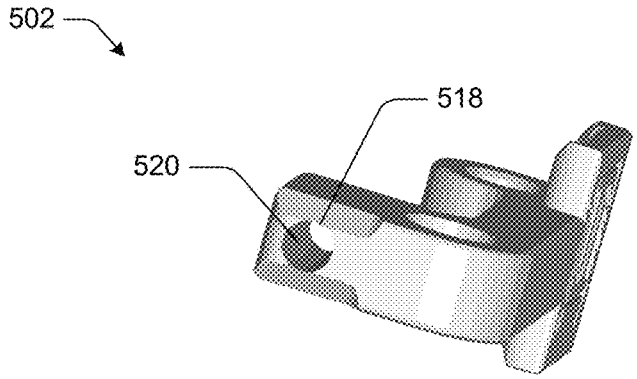
FIG. 5B depicts an isometric view of the lever of the rail system taken generally from a front that is further from the firearm receiver when the rail system is installed.
Figure 5C:
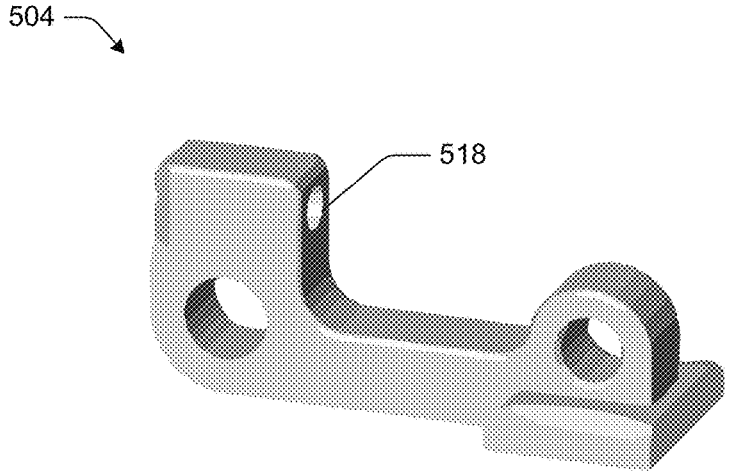
FIG. 5C depicts an isometric view of the lever of the rail system taken general from a side and generally along an axis of the barrel when the rail system is installed.

FIG. 5A depicts an isometric view 500 of a lever of the rail system of FIG. 1. FIG. 5B depicts an isometric view 502 of the lever of the rail system taken generally from a front that is further from the firearm receiver when installed and FIG. 5C depicts an isometric view 504 of the lever of the rail system taken general from a side of the rail. In this portion of the description, discussion is made interchangeably to FIGS. 5A-5C.

An instance of a rotatable assembly is implemented generally at 500 as a locking lever 508. In some aspects, the locking lever 508 is manipulated such that a portion of the locking lever engages a cavity of the barrel nut 106 to secure the modular rail to the barrel nut and firearm receiver. In this example, the locking lever 508 includes a transverse hole 510 by which the lever is configured to rotate about an axis 512 that is substantially parallel the transverse hole 510.

The locking lever 508 may also include a tab 514 to facilitate user manipulation of the lever by hand and/or without tools. In some cases, the locking lever 508 includes a transverse hole 516 configured to receive a sliding latch assembly and a longitudinal hole 518 configured to house or support a tensioning device. By way of example, consider 502 which illustrates a front surface of the locking lever that may engage the cavity of the barrel nut. Here, the longitudinal hole 518 includes a threaded portion 520, which can be configured to receive a set screw or tensioning screw. As shown at 504, the longitudinal hole 518 may be positioned such that a set screw can be accessed via a tool without interference from other features of the locking lever 508.

Figure 6A:
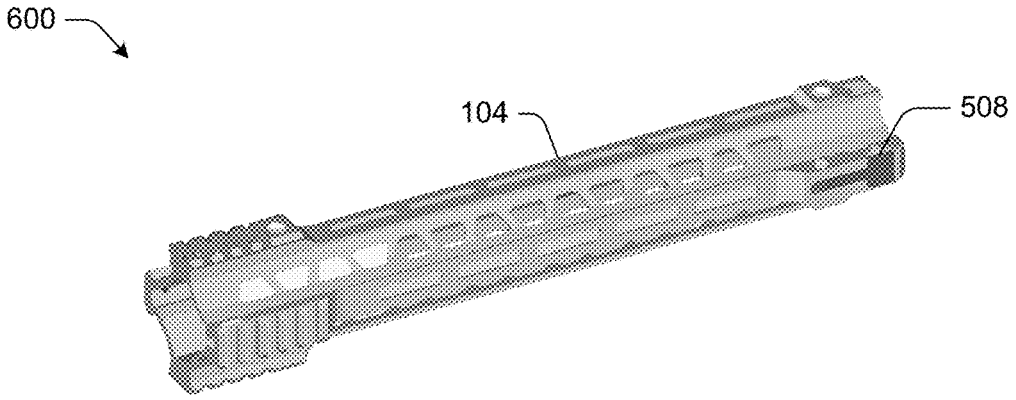
FIG. 6A depicts an isometric view of a modular rail that includes the lever of FIG. 5A.
Figure 6B:
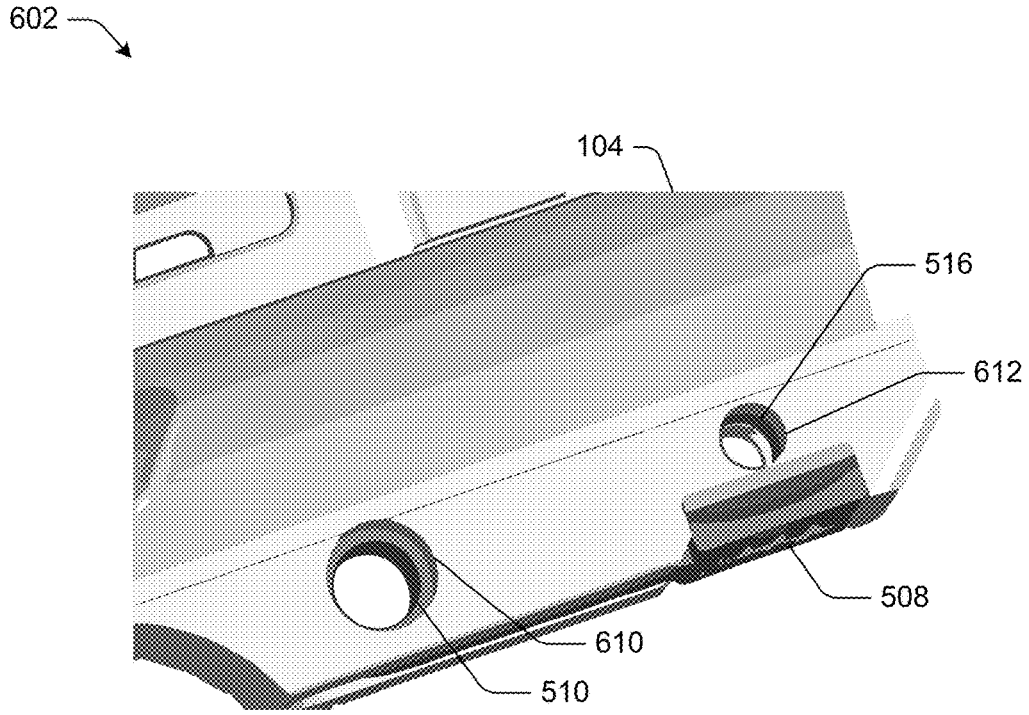
FIG. 6B depicts an isometric view of the lever as installed in the modular rail as taken generally from a side of the rail.

FIG. 6A depicts an isometric view 600 of a rail system generally from below and showing the locking lever of FIG. 5A installed. As shown at 600, the locking lever 508 may fit flush with an outer surface of the modular rail 104 when rotated into at least one position. FIG. 6B depicts another isometric view 602 of the lever as installed in the rail system as taken generally from a side of the rail system. Here, respective transverse holes 510 and 610 of the modular rail 104 and locking lever 508 may align to facilitate or house a hinge pin by which the locking lever rotates. Additionally, respective transverse holes 516 and 612 may also align to facilitate or house a sliding latch assembly to enable latching of the locking lever 508 in at least one position.

Figure 6C:
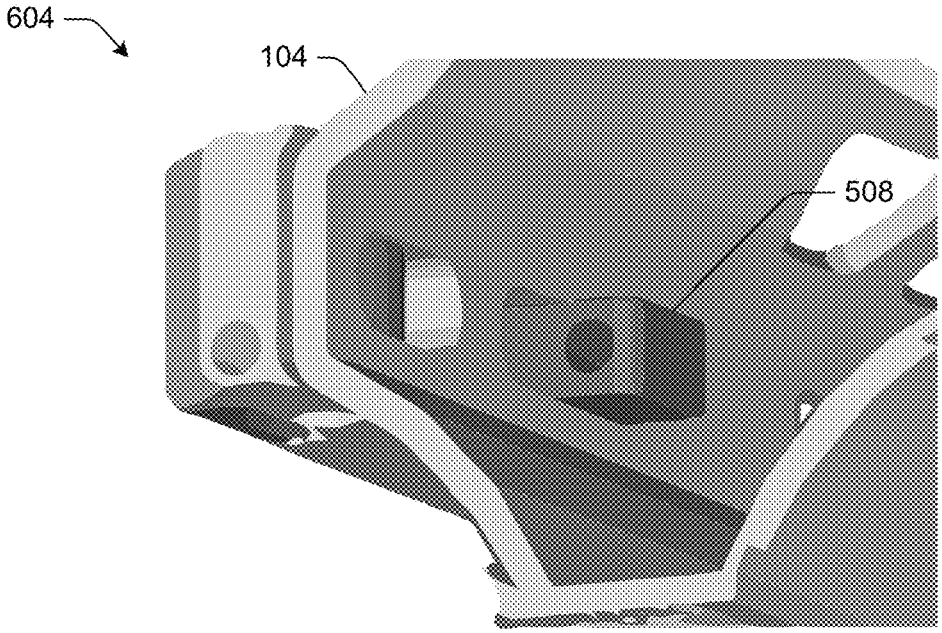
FIG. 6C depicts an isometric view of the lever in a locking position taken generally from a rear of the rail that is closer to the firearm receiver when installed.
Figure 6D:
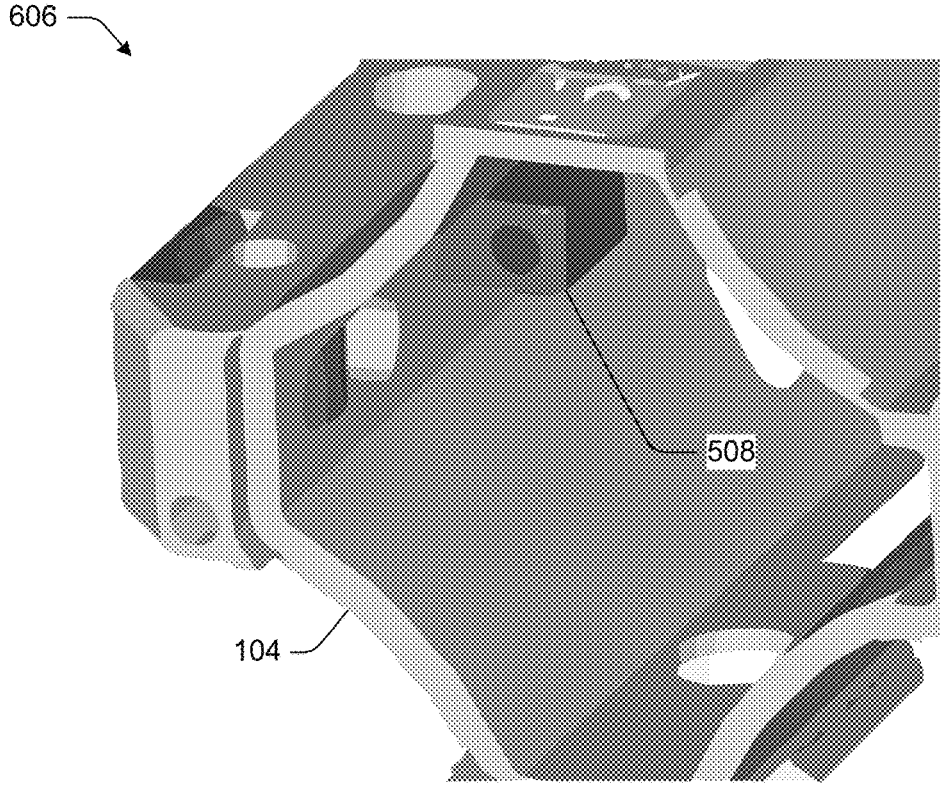
FIG. 6D depicts another isometric view of the lever in a locking position taken generally from the rear of the rail and a side opposing that of FIG. 6D.

FIGS. 6C and 6D depict respective isometric views 604, 606 of the locking lever in a position by which the modular rail can be secured or locked to the barrel nut. As shown at 604 and 606, a portion of the locking lever 508 extends through an inner surface of the modular rail 104 to engage the barrel nut 106. In some aspects, a face or edge of the locking lever 508 contacts, when in a locking position, the cavity of the barrel nut 106 in order to secure the modular rail 104 to the barrel nut 106.

Figure 7A:
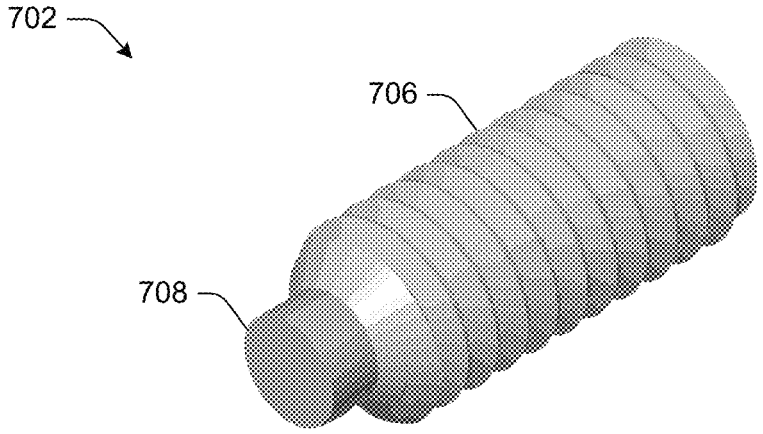
FIG. 7A depicts an isometric view of a tensioning screw of the lever of the rail system.
Figure 7B:
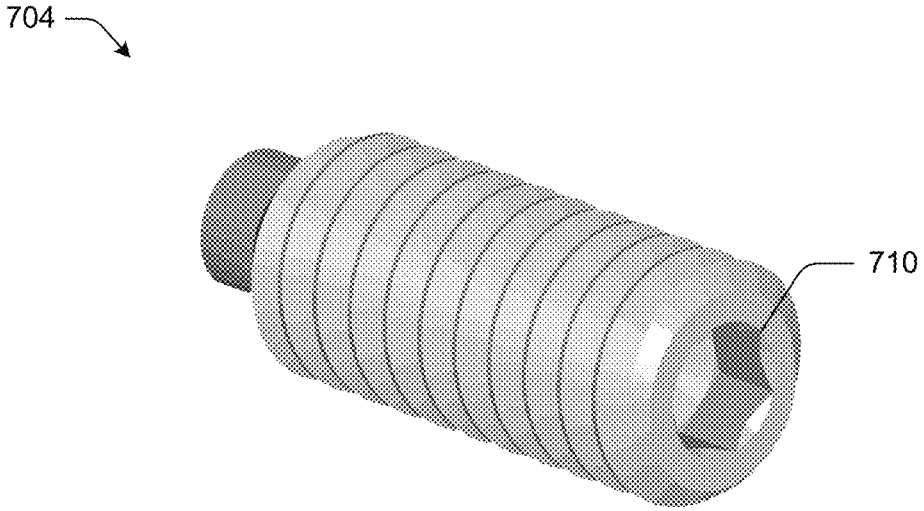
FIG. 7B depicts an isometric view of a tensioning screw of the lever of the rail system taken generally from a view opposing that of FIG. 7A.

FIG. 7A depicts an isometric view 702 of a tensioning screw for the locking lever of the rail system. FIG. 7B depicts an isometric view 704 of the tensioning screw of the lever of the rail system taken generally from a view opposing that of FIG. 7A. As noted, a face or surface of the locking lever 508 may engage the cavity (or slot) of the barrel nut to secure the modular rail 104 to the barrel nut. To provide tension adjustment or control, the locking lever 508 may also include a tensioning screw 706. The tensioning screw may be configured to thread into the longitudinal hole 518 of the locking lever 508 and move longitudinally to increase or decrease an amount of force applied to the cavity of the barrel nut. The tensioning screw includes a contact surface 708 that can engage a corresponding surface of the cavity and a tool interface 710 (e.g., hex or torx) to facilitate adjustment of the tensioning screw 706. Alternately or additionally, a set screw or thread lock adhesive may be used to prevent the tensioning screw 706 from moving once a desired amount of tension between the rail and barrel nut is achieved.

Figure 8A:
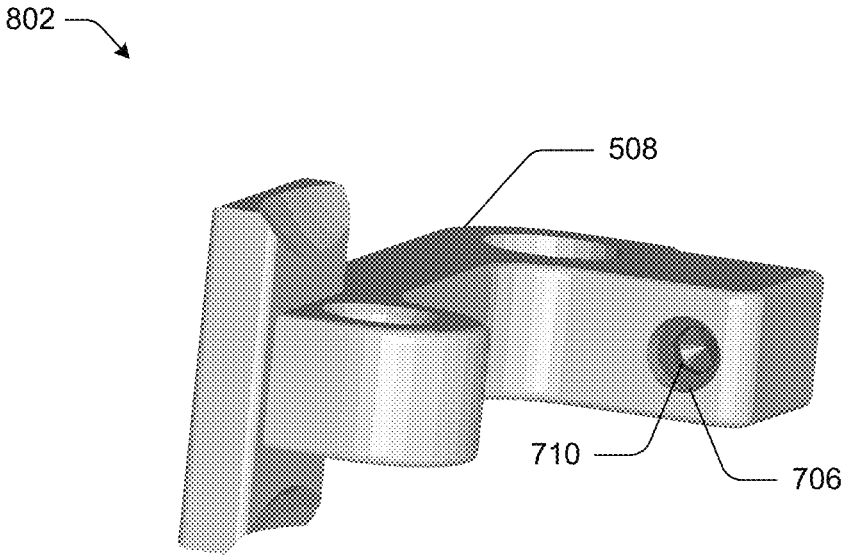
FIG. 8A depicts an isometric view of the tensioning screw as installed in the lever of the rail system taken generally from a rear of the lever.
Figure 8B:
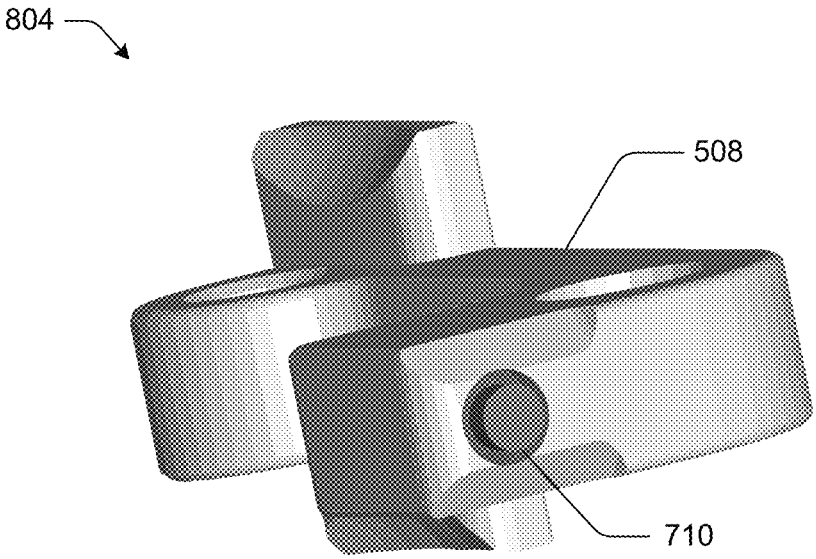
FIG. 8B depicts an isometric view of the tensioning screw as installed in the lever of the rail system taken generally from a front of the lever.

FIG. 8A depicts an isometric view 800 of the tensioning screw as installed in the lever of the rail system taken generally from a rear of the lever and FIG. 8B depicts an isometric view 802 of the tensioning screw as installed in the lever of the rail system taken generally from a front of the lever. As shown at 802, the tool interface 710 of the tensioning screw 706 is accessible from a rear of the locking lever 508. At 804, the contact surface 708 of the tensioning screw is shown relative a surface of the locking lever 508.

Figure 9:
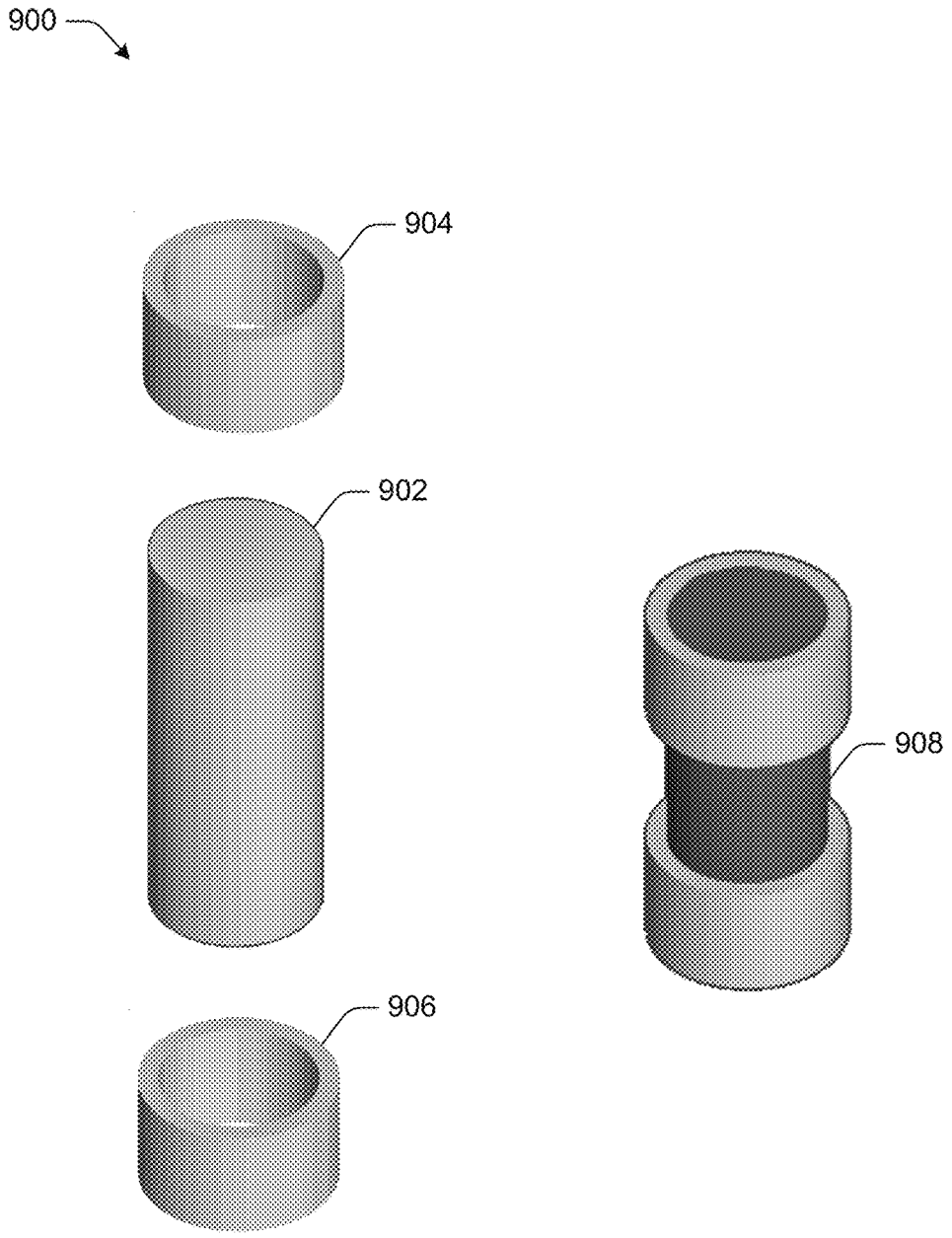
FIG. 9 depicts an isometric view of hinge pin assembly of the lever of the rail system that includes bushings and a pin.
Figure 10A:
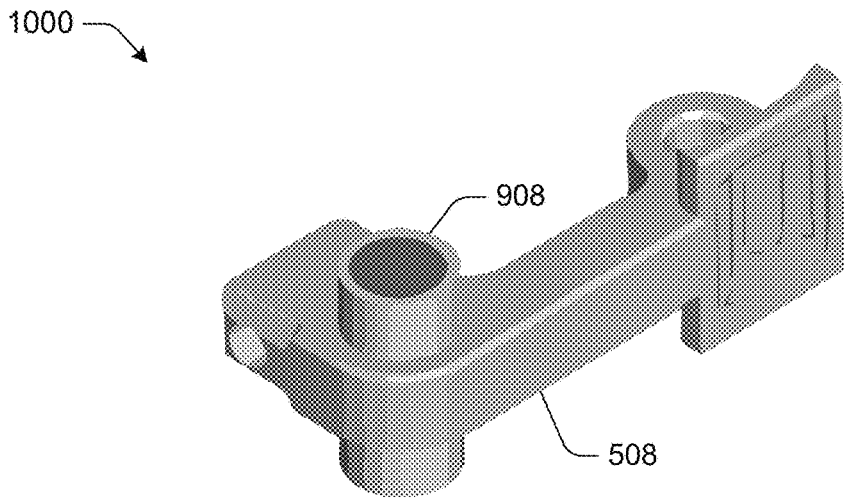
FIG. 10A depicts an isometric view of the hinge pin assembly as installed in the lever of FIG. 5A.
Figure 10B:
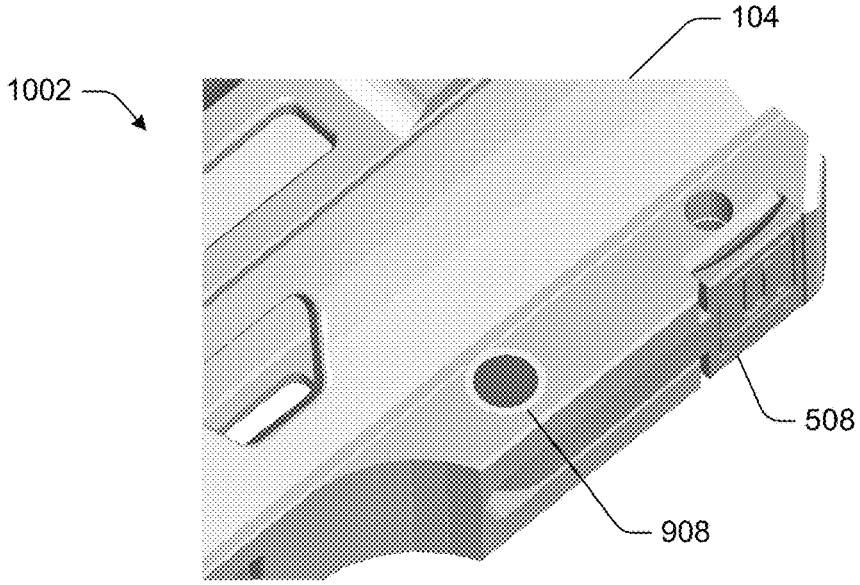
FIG. 10B depicts an isometric view of the hinge pin assembly and lever as installed in the rail system of FIG. 6B.

FIG. 9 depicts an isometric view 900 of hinge pin assembly for the lever of the rail system. As shown at 900, a hinge pin 902 and bushings 904, 906 may be combined to form a hinge assembly 908 for the locking lever. One of the bushings 904, 906 may be pressed on the hinge pin after insertion of the hinge pin through the locking lever 508 and modular rail 104. By so doing, the bushings 904, 906 may be used to capture the hinge pin and ensure retention of the hinge assembly 908 in the modular rail 104. FIG. 10A depicts an isometric view 1000 of the hinge pin assembly 908 as installed in the locking lever 508. FIG. 10B depicts an isometric view 1002 of the hinge pin assembly and lever as installed in the rail system of FIG. 1. As shown at 1002, the hinge pin and bushings may be selected or machined such that the outer surface of the hinge assembly is approximately flush with an outer surface of the modular rail 104.

Figure 11A:
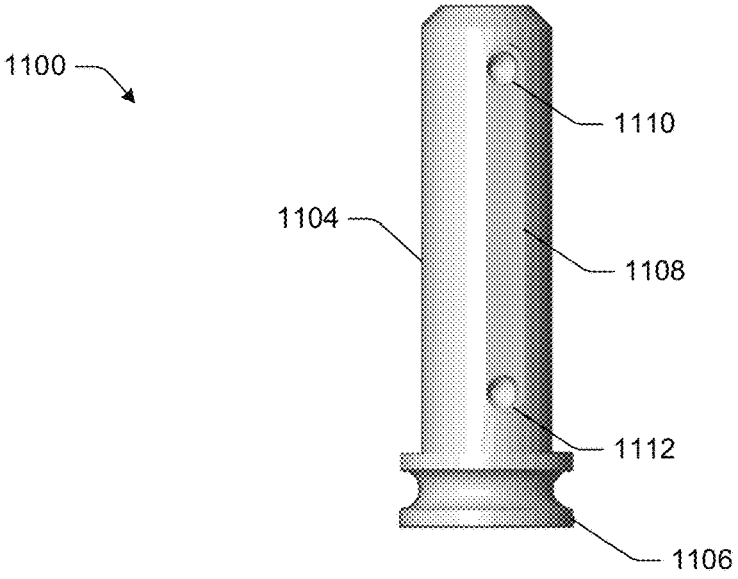
FIG. 11A depicts an isometric view of a latch pin of the lever taken generally along an axis of movement and showing pin retention features.
Figure 11B:
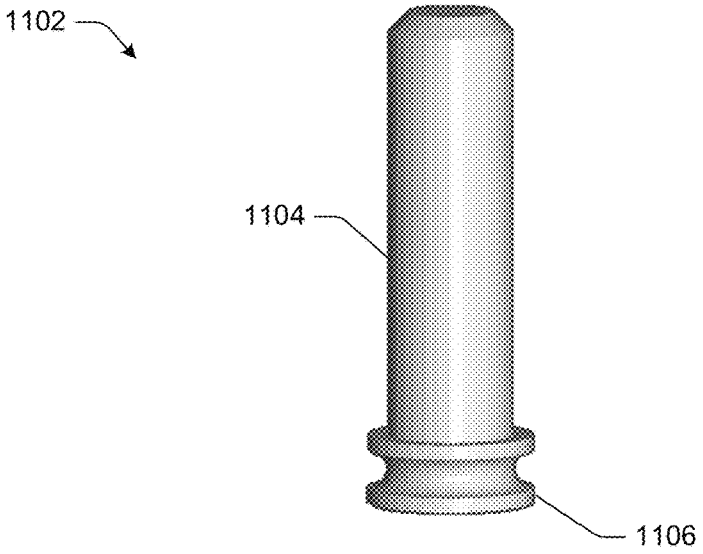
FIG. 11B depicts an isometric view of the latch pin taken generally from a view opposing that of FIG. 11A.

FIG. 11A depicts an isometric view 1100 of a latch pin for the locking lever taken generally along an axis of movement. The latch pin 1104 may be a captive or retained latch pin that is manipulable without the use of tools. In this example, the latch pin includes a pull feature 1106 by which a user can extract the pin from the locking lever and modular rail. The latch pin also includes a slot 1108 in which a detent may ride and detent stops 1110, 1112 that limit travel or throw of the latch pin. FIG. 11B depicts an isometric view 1102 of the latch pin taken generally from generally from a view opposing that of FIG. 11A. Alternately, the latch pin 1104 may be implemented as a non-captive latch pin without the slot 1108 and detent stops 1110, 1112.

Figure 12A:
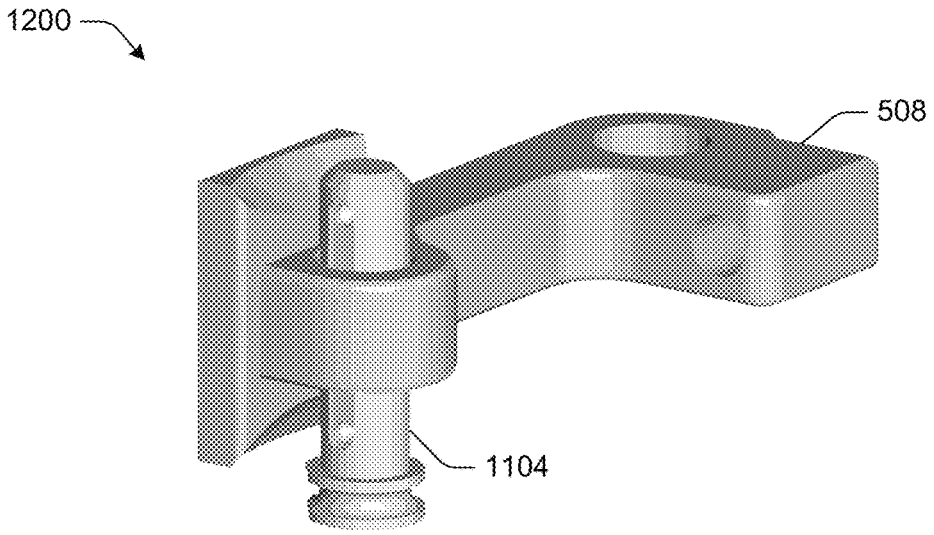
FIG. 12A depicts an isometric view of the latch pin as installed in the lever of FIG. 5A.
Figure 12B:
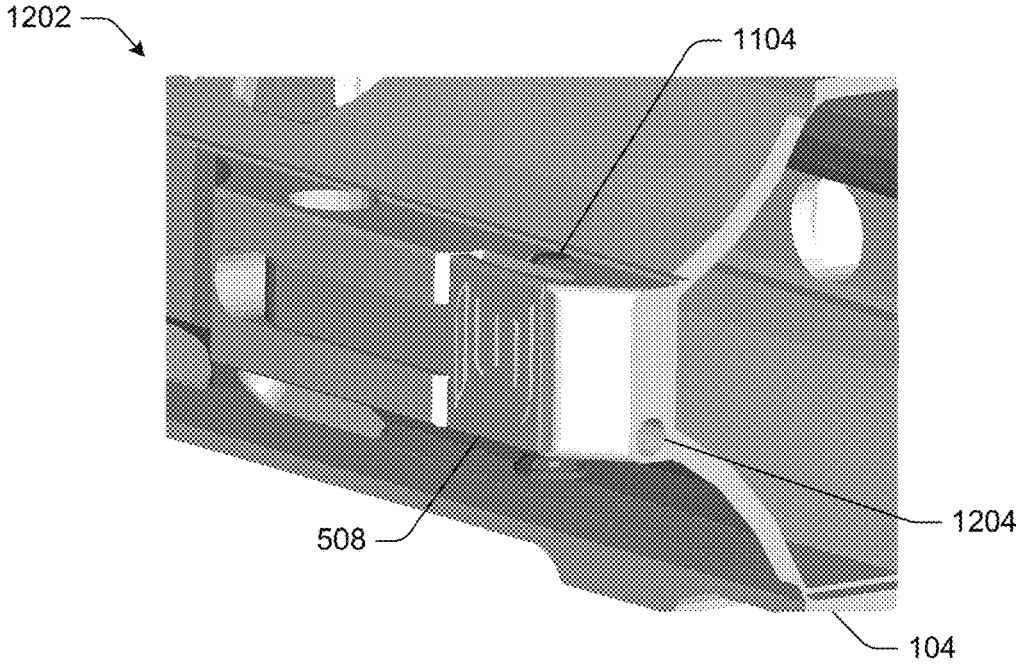
FIG. 12B depicts an isometric view of the latch pin and lever as installed in the modular rail of FIG. 1.

FIG. 12A depicts an isometric view 1200 of the latch pin as installed in a locking lever. As shown at 1200, detent stops of the latch pin 1104 may be configured such that at least one of the detent stops may be engaged regardless of the latch pins position relative the locking lever 508. FIG. 12B depicts an isometric view 1202 of the latch pin and locking lever as installed in the rail system. Here, note that the locking lever 508 is in a position for locking the modular rail 104 to the barrel nut 106 and that the latch pin 1104's position through the lever and rail prevents the locking lever from opening. The modular rail 104 may also include a detent hole configured receive a detent, detent spring, and spring backing device (e.g., set screw).

The following discussion describes example techniques for installation or removal of a rail system. These techniques can be implemented in the example environment or with entities thereof, such as the rail system 102 that includes a modular rail 104 and barrel nut 106. These techniques include a method illustrated in FIG. 13, which is shown as a set of operations or acts performed in association with installing or assembling the rail system. Although described with reference to installation or assembly, operations or acts of the method may be implemented in alternate or reverse order to implement techniques for uninstallation or disassembly of the rail system or components thereof. This and other methods described herein are not necessarily limited to the orders shown or listed for performing the operations. In the following discussion, reference may be made to the example environment or entities of FIGS. 1 through 12B by way of example. Such reference should not be taken as limiting the techniques to the environment, but illustrative of one of a variety examples.

Figure 13:
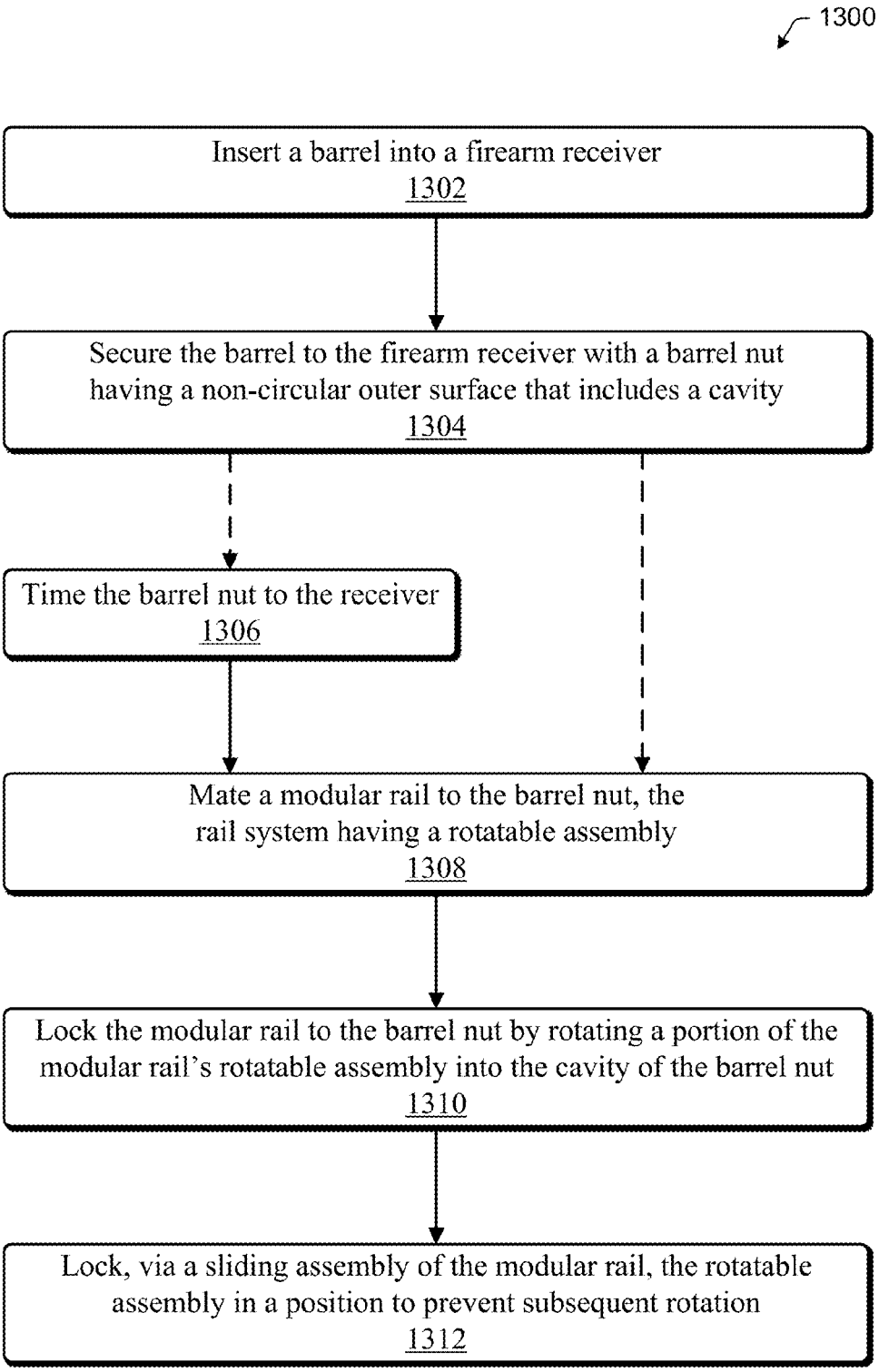
FIG. 13 illustrates an example method for mounting a modular rail to a firearm receiver in accordance with one or more embodiments.

FIG. 13 depicts a method 1300 for example method for mounting a rail system to a firearm receiver in accordance with one or more embodiments.

At 1302, a barrel is inserted into a firearm receiver. The barrel may be inserted into a barrel receiving portion of the receiver that includes threads having Mil-Spec dimensions and pitch, such as an AR-15 upper receiver. An extension of the barrel may be interposed between the receiver and the barrel effective to set or provide correct head spacing of the barrel with respect to a bolt housed by the receiver. Alternately or additionally, the barrel may include an index pin to facilitate alignment or timing responsive to the index pin being seating in a corresponding channel or notch of the upper receiver.

At 1304, the barrel of the firearm is secured to the firearm receiver with a barrel nut having a non-circular outer surface when taken along an axis that is perpendicular to an axis of the barrel. The barrel nut also includes a cavity formed into the non-circular outer surface. In some cases, the cavity is formed into a flat area of the outer surface or along a bottom surface of the barrel nut.

Optionally at 1306, the barrel is timed or indexed to the receiver. The barrel nut may be timed such that the cavity on the outer surface of the barrel nut is located approximately bottom dead center (BDC) with respect to an index pin of the barrel, an index pin of an extension of the barrel, or the firearm receiver (e.g., a top rail of the receiver). Alternately or additionally, the barrel nut may be timed such that a gas tube channel of the barrel nut is timed top dead center (TDC) with respect to an index pin of the barrel, an index pin of an extension of the barrel, or the firearm receiver (e.g., a top rail of the receiver). In some cases, threads of the barrel nut and receiver are cut, turned, or otherwise formed such that the barrel nut times to the receiver at a predetermined position in response to an application of torque ranging from approximately 25 foot-pounds to 115 foot-pounds. Alternately, the barrel nut may be timed by inserting shims or shim material between an inner surface (e.g., shoulder) of the barrel nut and a collar of the barrel's extension.

At 1308, a modular rail is mated to the barrel nut. The modular rail includes an inner surface or portion that has a shape that is complementary to the outer surface of the barrel nut. The mating of these respective surfaces, such as by sliding the modular rail over the barrel nut, can be effective to prevent the modular rail from rotating with respect to the barrel. Alternately or additionally, the modular rail and barrel nut may include complementary alignment features that assist with alignment and seating of the modular rail over the barrel nut.

Figure 14:
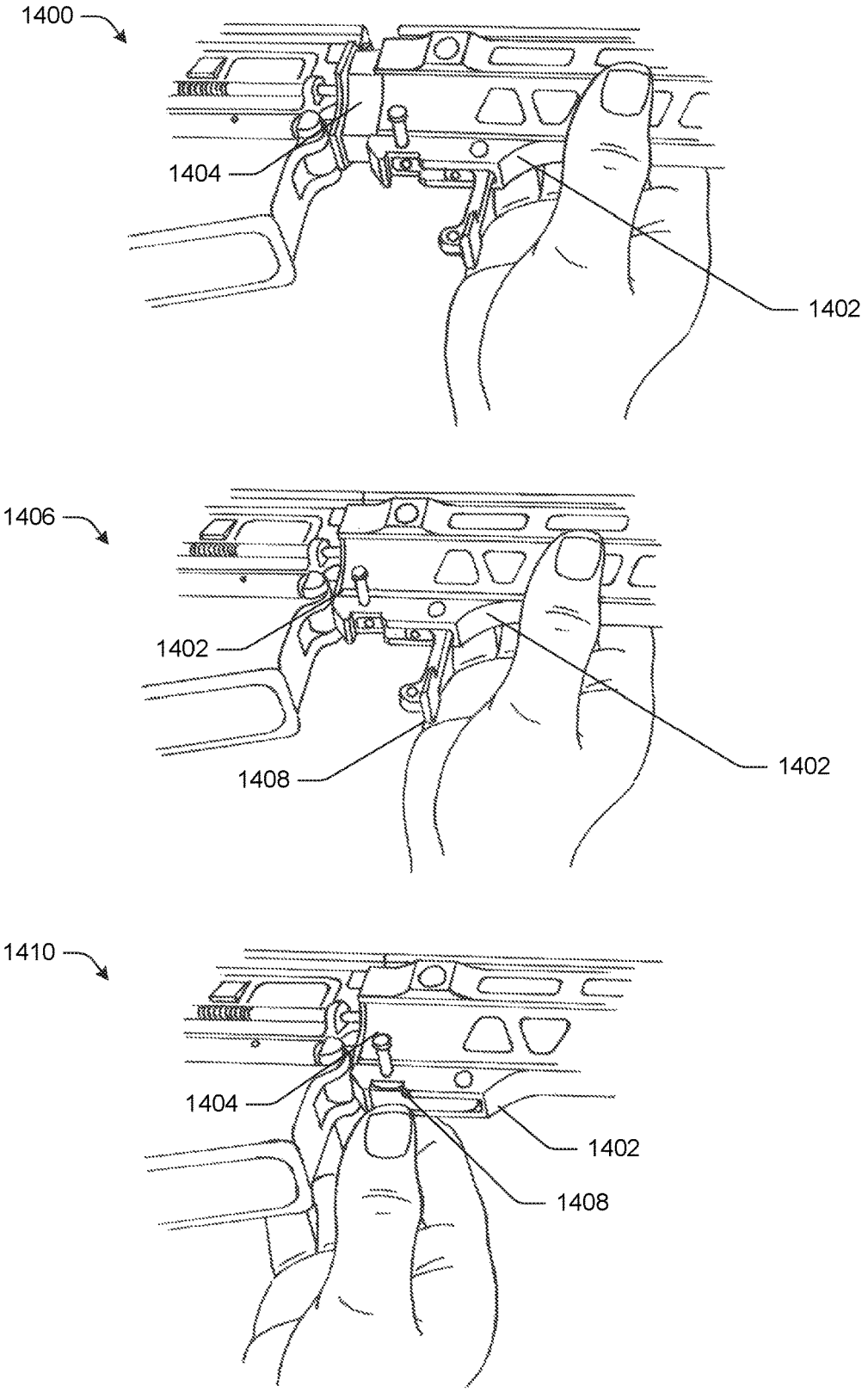
FIG. 14 illustrates example implementations in which a modular rail system is mounted to a firearm's upper receiver.
Figure 15:
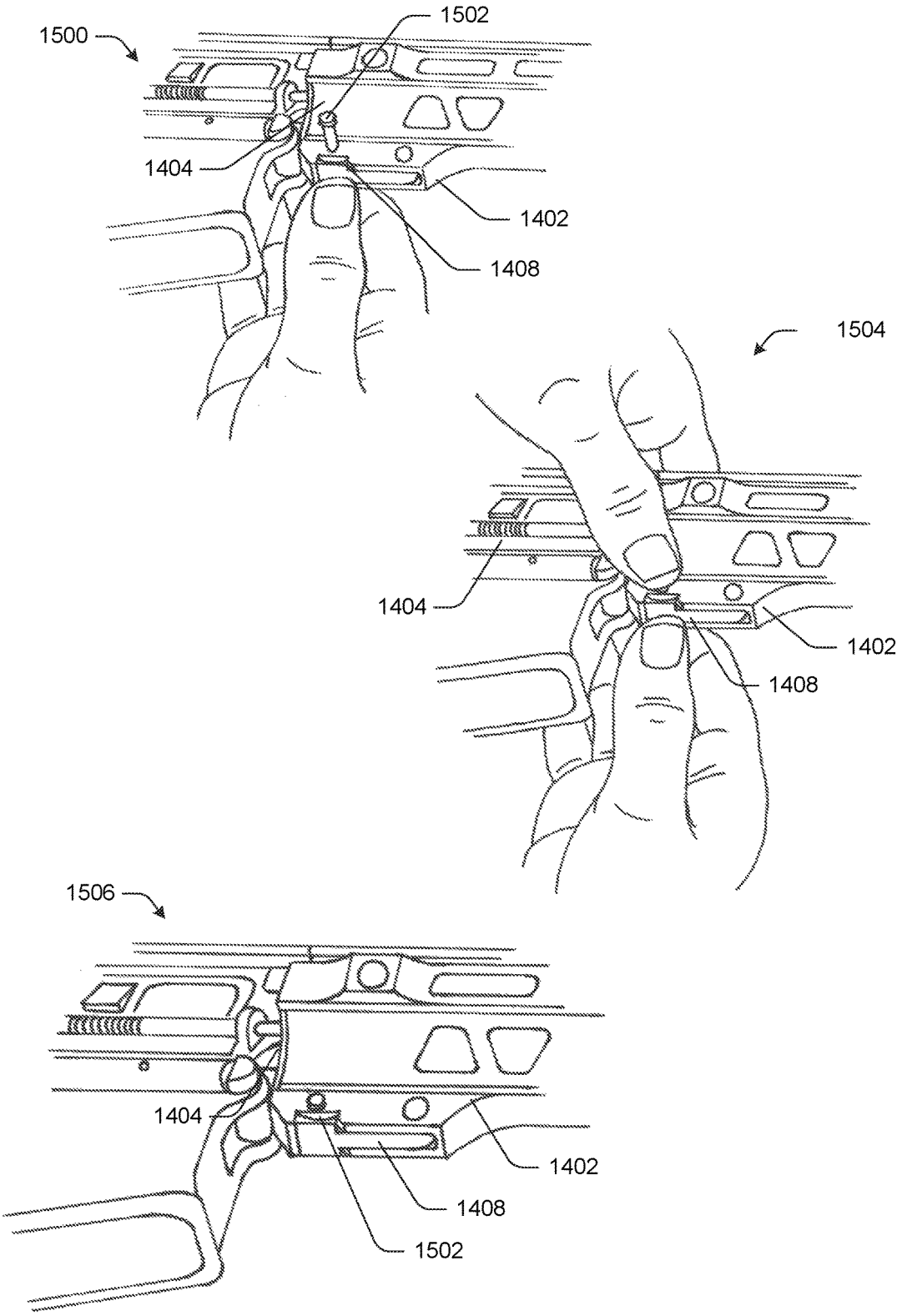
FIG. 15 illustrates example implementations in which assemblies of a rail system are manipulated to lock a modular rail to a barrel nut.

By way of example, consider FIGS. 14 and 15 which illustrate example steps for mating and/or securing a modular rail to a barrel nut. Here, assume that the barrel nut has been installed such that a cavity of the barrel nut is timed or indexed to BDC with respect to a top rail of the upper receiver. Alternately, the barrel nut may be timed or indexed such that a gas tube channel of the barrel nut is timed to TDC with respect to the top rail of the upper receiver. FIG. 14A illustrates, at 1400, a user sliding a modular rail 102 over a barrel nut 1404 that has been installed on an AR-15 type upper receiver. As shown at 1406, the modular rail 1402 slides over the barrel nut 1404 until respective alignment features of each part meet. Here, note that a locking lever 1408 of the modular rail 1402 is not yet engaged with a cavity of the barrel nut.

At 1310, the modular rail is locked to the barrel nut by rotating a portion of the modular rail's rotatable assembly into the cavity of the barrel nut. The rotatable assembly may comprise any suitable type of assembly, such as a lever or cam surface. In some cases, the portion of the rotatable portion engages the cavity of the barrel nut to lock the modular rail to the barrel nut. Alternately or additionally, the rotatable assembly may include a tensioning screw. In such cases, the tensioning screw may be adjusted to increase or decrease tension applied to the cavity of the barrel nut. This can be effective to pull or tighten the modular rail into the barrel nut to reduce space or travel of the modular rail along the axis of the barrel.

Continuing the present example, the user rotates the locking lever 1408 of the modular rail 1402 to lock the modular rail 1402 to the barrel nut 1404, and thus the receiver of the firearm. Here, note that the locking lever is manipulable without the use of tools, thereby enabling the user to lock or unlock the modular rail by hand.

At 1312, the rotatable assembly of the modular rail is locked into position via a sliding assembly of the modular rail to prevent subsequent rotation. The sliding assembly of the modular rail may include a pin or slider configured to engage the locking lever in a position in which the lever locks the modular rail to the barrel nut. The sliding assembly of the modular rail may also be captive or restrained such that movement of the pin is restricted or limited between two or more predetermined positions. Alternately or additionally, the sliding assembly may be manipulable without the use of tools, thereby enabling a user to lock or unlock the modular rail by hand.

Concluding the present example, consider FIG. 15 which illustrates the modular rail 1402 locked to the barrel nut 1404 via the locking lever 1408 at 1500. In this position, a hole disposed through the locking lever 1408 is aligned with latch pin 1502 of the modular rail. As shown at 1504, the user pushes the latch pin 1408 through the hole of the locking lever 1408 in order to secure the locking lever 1408 in position. With the locking lever 1408 and latch pin 1502 in respective "locked" positions, at 1506, the modular rail 1402 is aligned and securely mounted to the barrel nut 1404.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:
- a barrel of a firearm;
- a firearm receiver of the firearm having a barrel receiving portion;
- a single barrel nut configured to:
  - secure the barrel of the firearm to the firearm receiver;
  - directly contact the barrel receiving portion of the firearm receiver of the firearm when secured;
  - be disposed adjacent to the barrel of the firearm when secured; and
  - have a non-circular outer surface when taken along an axis that is perpendicular to an axis of the barrel when secured to the firearm, the non-circular outer surface being disposed on an opposing side of the single barrel nut with respect to an inner surface of the single barrel nut, the outer surface of the single barrel nut having a cavity; and
- a modular rail configured to:
  - have an inner portion having a shape that is complementary to the single barrel nut such that the modular rail does not rotate about the axis of the barrel when the inner portion of the modular rail is mated to the outer surface of the single barrel nut;
  - a rotatable assembly configured to engage the cavity of the single barrel nut such that the modular rail does not move along the axis of the barrel and having a lever that is rotatable between at least two positions:
    - a first of the positions being one in which a portion of the lever engages the cavity of the single barrel nut to prevent the rail from moving along the axis of the barrel effective to secure the modular rail to the firearm; and
    - a second of the positions being one in which a portion of the lever does not engage the cavity of the single barrel nut and the modular rail is separable from the firearm; and
  - attach directly to the barrel nut when the inner portion of the modular rail is mated to the outer surface of the single barrel nut.

2. The apparatus as described in claim 1, wherein the modular rail further comprises a pin assembly to secure the lever in the first position.

3. The apparatus as described in claim 2, where the pin assembly of the modular rail is captive or movable without the use of tools.

4. The apparatus as described in claim 1, wherein the portion of the lever that engages the cavity of the single barrel nut includes a screw by which engagement with the cavity is adjustable.

5. The apparatus as described in claim 1, wherein the outer surface of the single barrel nut further comprises a channel configured to facilitate passage of a gas tube or piston assembly of the firearm.

6. The apparatus as described in claim 5, wherein the channel and the cavity of the single barrel nut are located on approximately opposite portions of the outer surface of the single barrel nut.

7. The apparatus as described in claim 1, wherein the single barrel nut comprises threads that are configured to time the single barrel nut such that the cavity is located at approximately bottom dead center with respect to an index pin of the barrel when the single barrel nut is torqued between a range of 25 foot-pounds and 115 foot-pounds.

8. The apparatus as described in claim 1, wherein the outer surface of the single barrel nut comprises at least two parallel portions that are perpendicular to a longitudinal axis of the barrel when secured to the firearm.

9. The apparatus as described in claim 1, wherein the non-circular outer surface of the single barrel nut comprises at least four portions that are substantially flat and four portions that are substantially concave in shape.

10. A firearm comprising:
- a barrel of the firearm;
- a receiver of the firearm having a barrel receiving portion;
- a single barrel nut configured to:
  - secure the barrel of the firearm to the firearm receiver;
  - directly contact the barrel receiving portion of the firearm receiver of the firearm when secured;
  - be disposed adjacent to the barrel of the firearm when secured; and
  - have a non-circular outer surface when taken along an axis that is perpendicular to an axis of the barrel when secured to the firearm, the non-circular outer surface:
    - being disposed on an opposing side of the single barrel nut with respect to an inner surface of the single barrel nut; and having a cavity included in a protrusion of the single barrel nut, the cavity being disposed on the opposing side of the single barrel nut; and a modular rail configured to:

have an inner portion having a shape that is complementary to the single barrel nut such that the modular rail does not rotate about the axis of the barrel when the inner portion of the modular rail is mated to the outer surface of the single barrel nut;

attach directly to the barrel nut when the inner portion of the modular rail is mated to the outer surface of the single barrel nut; and include a rotatable assembly configured to engage the cavity of the single barrel nut such that the modular rail does not move along the axis of the barrel, the rotatable assembly including a lever that is rotatable between at least two positions:

a first of the positions being one in which a portion of the lever engages the cavity of the single barrel nut to prevent the rail from moving along the axis of the barrel effective to secure the modular rail to the firearm; and a second of the positions being one in which a portion of the lever does not engage the cavity of the single barrel nut and the modular rail is separable from the firearm.

11. The firearm as described in claim 10, wherein the modular rail further comprises a pin assembly to secure the lever in the first position.

12. The firearm as described in claim 11, where the pin assembly of the modular rail is captive or movable without the use of tools.

13. The firearm as described in claim 11, wherein the portion of the lever that engages the cavity of the single barrel nut includes a screw by which engagement with the cavity is adjustable.

14. An apparatus comprising:

a barrel of a firearm;

a firearm receiver of the firearm having a barrel receiving portion;

a single barrel nut configured to:

secure the barrel of the firearm; and have a non-circular outer surface when taken along an axis that is perpendicular to an axis of the barrel when secured to the firearm, the non-circular outer surface of the single barrel nut including a portion that is substantially concave in shape and extends inward toward an inner surface of the single barrel nut, the non-circular outer surface including a channel configured to align with a gas tube passage of the firearm receiver and a cavity approximately opposite of the channel, the cavity enabling the modular rail to be secured to the single barrel nut and the firearm receiver; and a modular rail having an inner portion having a shape that is complementary to the single barrel nut such that:

the inner portion of the modular rail contacts the portion of the single barrel nut that is substantially concave in shape and extends inward toward the inner surface of the single barrel nut; and the modular rail does not rotate about the axis of the barrel when the inner portion of the modular rail is mated to the outer surface of the single barrel nut.

15. The apparatus as described in claim 14, wherein the outer surface of the single barrel nut further comprises at least two parallel portions that are perpendicular to a longitudinal axis of the barrel when secured to the firearm.

16. The apparatus as described in claim 14, wherein the non-circular outer surface of the single barrel nut comprises at least four portions that are substantially flat and at least four portions that are substantially concave in shape.

* * * * *